US011484100B2

(12) United States Patent
Ghidirmic

(10) Patent No.: US 11,484,100 B2
(45) Date of Patent: Nov. 1, 2022

(54) COMPARTMENTED BRACELET

(71) Applicant: Pacific Capital Partners, Unipessoal, Lda, Lisbon (PT)

(72) Inventor: Ini Ghidirmic, St. Joseph, MI (US)

(73) Assignee: Pacific Capital Partners, Unipessoal, Lda, Lisbon (PT)

( * ) Notice: Subject to any disclaimer, the term of this patent is extended or adjusted under 35 U.S.C. 154(b) by 0 days.

(21) Appl. No.: 17/111,361

(22) Filed: Dec. 3, 2020

(65) Prior Publication Data

US 2022/0175096 A1 Jun. 9, 2022

(51) Int. Cl.
*A44C 5/00* (2006.01)

(52) U.S. Cl.
CPC ..... *A44C 5/003* (2013.01); *A44C 5/0084* (2013.01); *A44D 2200/10* (2013.01)

(58) Field of Classification Search
CPC .. A44C 5/14; A44C 5/003; A44C 5/16; A44C 5/0084; Y10T 24/4782; G04B 37/0008; G04B 37/1496; G04B 37/16; G04B 37/18; A45C 1/04; A45F 2200/05; A45F 2200/00; A45F 2200/0575; A45F 2005/008; A44D 2200/10
USPC ..... 368/282; 224/165, 267, 237, 241, 219, 224/231; 63/1.14
See application file for complete search history.

(56) References Cited

U.S. PATENT DOCUMENTS

| | | | | |
|---|---|---|---|---|
| 8,286,834 | B2 * | 10/2012 | Powers | A45F 5/00 222/491 |
| 2010/0237115 | A1 * | 9/2010 | Booker | A61J 1/035 224/267 |
| 2013/0104599 | A1 * | 5/2013 | Beldiman | A44C 5/003 63/1.14 |
| 2019/0239601 | A1 * | 8/2019 | Frietsch | A44C 5/003 |
| 2021/0052045 | A1 * | 2/2021 | Frietsch | A44C 5/003 |
| 2021/0353016 | A1 * | 11/2021 | Avitall | A44C 15/002 |
| 2021/0368951 | A1 * | 12/2021 | Monge | A45C 1/04 |

FOREIGN PATENT DOCUMENTS

GB 103713 A * 2/1917

* cited by examiner

*Primary Examiner* — Jack W Lavinder
(74) *Attorney, Agent, or Firm* — Vierra Magen Marcus LLP

(57) ABSTRACT

A bracelet is described including a first compartment configured to store a mask and second compartment configured to store a flask for dispensing a solution, such as for example an antibacterial gel. In one embodiment, the flask compartment may be worn on the side of the wrist adjacent the palm, so that pressing on the compartment can dispense solution directly into the palm of the wearer. The bracelet may have a variety fashionable and ornamental appearances with the first and/or second compartments built into a front or rear of the bracelet.

19 Claims, 16 Drawing Sheets

Fig. 11B
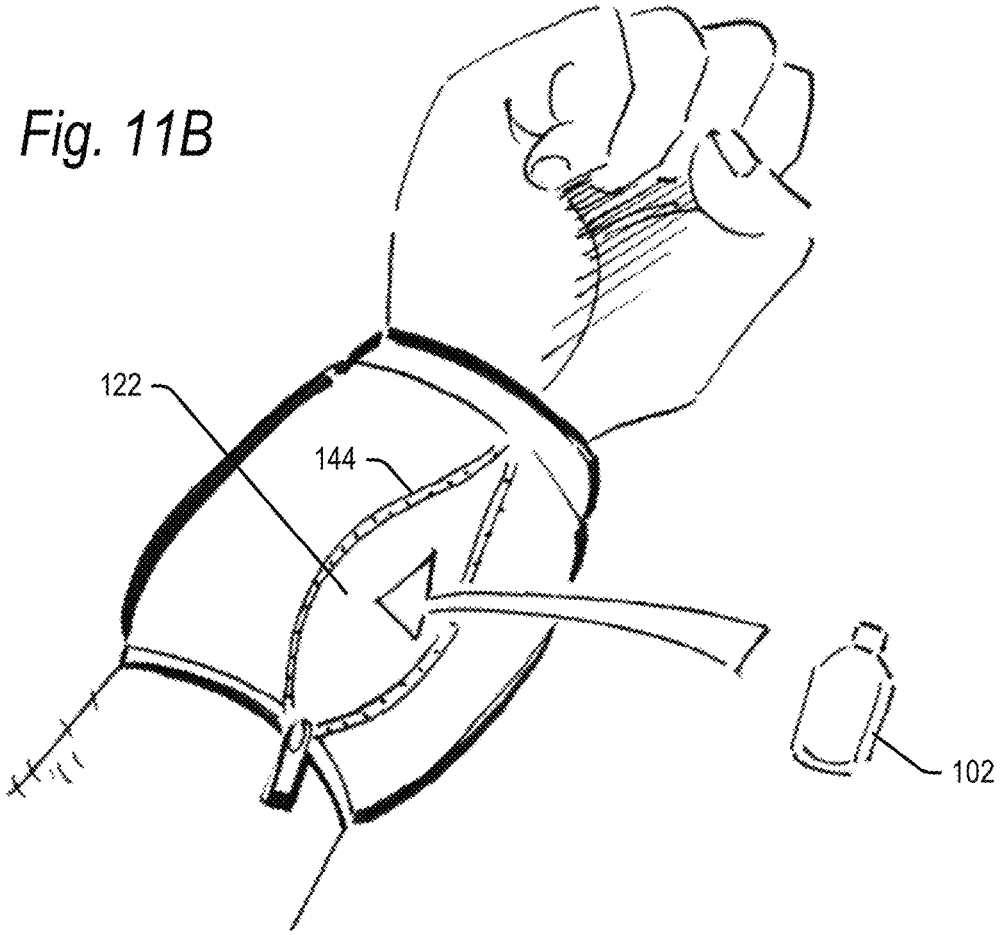
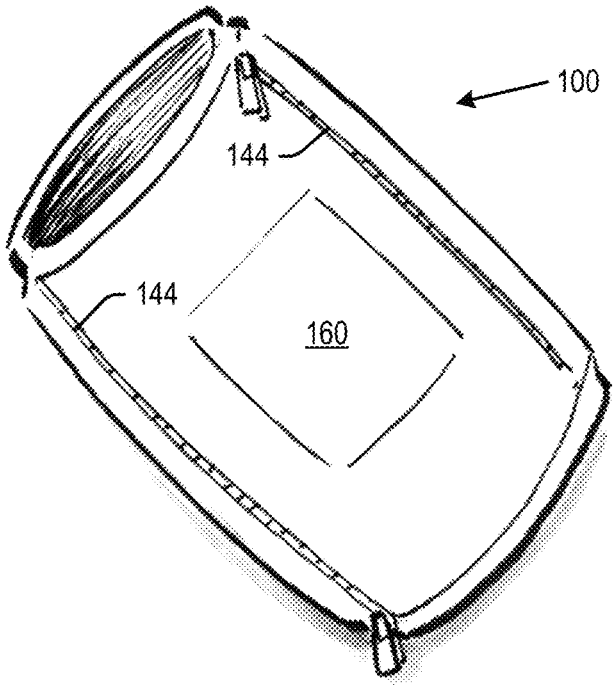
Fig. 11C

COMPARTMENTED BRACELET

BACKGROUND

Given the COVID-19 pandemic, people are compelled and/or required to wear masks when in public places. As people are not used to carrying around a mask, people often leave their homes or cars without their mask, forcing them to face others in public without their mask or forcing them to backtrack to retrieve their mask. Similarly, people often find themselves in a public setting where they would like to sanitize their hands with antibacterial gel but they forgot to bring the gel with them and do not otherwise have access to hand gel.

BRIEF DESCRIPTION OF THE DRAWINGS

Aspects of the present disclosure are illustrated by way of example and are not limited by the accompanying figures for which like references indicate the same or similar elements.

FIG. 11B is a rear view of the bracelet shown in FIG. 11A.

FIG. 11C is a further view of the bracelet shown in FIG. 11A.

DETAILED DESCRIPTION

The present technology will now be described with reference to figures, which in general relate to a bracelet including a first compartment configured to store a mask and second compartment configured to store a flask for dispensing a solution, such as for example an antibacterial gel. In one embodiment, the flask compartment may be worn on the anterior side of the wrist adjacent the palm, so that pressing on the compartment can dispense solution directly into the palm of the wearer. The bracelet may have a variety fashionable and ornamental appearances with the first and/or second compartments built into a front or rear surface of the bracelet.

It is understood that the present technology may be embodied in many different forms and should not be construed as being limited to the embodiments set forth herein. Rather, these embodiments are provided so that this disclosure will be thorough and complete and will fully convey the technology to those skilled in the art. Indeed, the technology is intended to cover alternatives, modifications and equivalents of these embodiments, which are included within the scope and spirit of the technology as defined by the appended claims. Furthermore, in the following detailed description of the present technology, numerous specific details are set forth in order to provide a thorough understanding of the present technology. However, it will be clear to those of ordinary skill in the art that the present technology may be practiced without such specific details.

The terms "front" and "rear," "top" and "bottom," "upper" and "lower" and "vertical" and "horizontal," and forms and synonyms thereof, as may be used herein are by way of example and illustrative purposes only, and are not meant to limit the description of the technology inasmuch as the referenced item can be exchanged in position and orientation.

For purposes of this disclosure, a connection may be a direct connection or an indirect connection (e.g., via one or more other parts). In some cases, when a first element is referred to as being connected, affixed or coupled to a second element, the first and second elements may be directly connected, affixed or coupled to each other or indirectly connected, affixed or coupled to each other. When a first element is referred to as being directly connected, affixed or coupled to a second element, then there are no intervening elements between the first and second elements.

Figure 1:
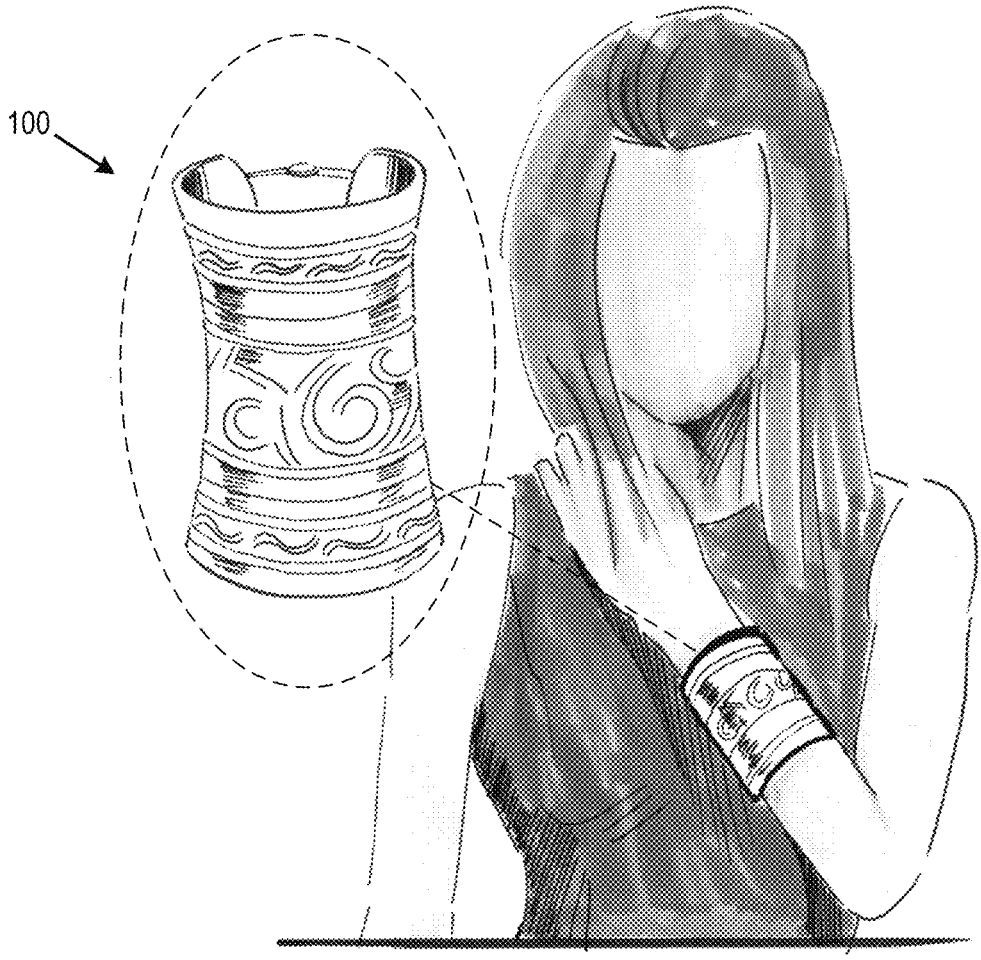
FIG. 1 illustrates a front view bracelet worn by a person according to a first embodiment.
Figure 2A:
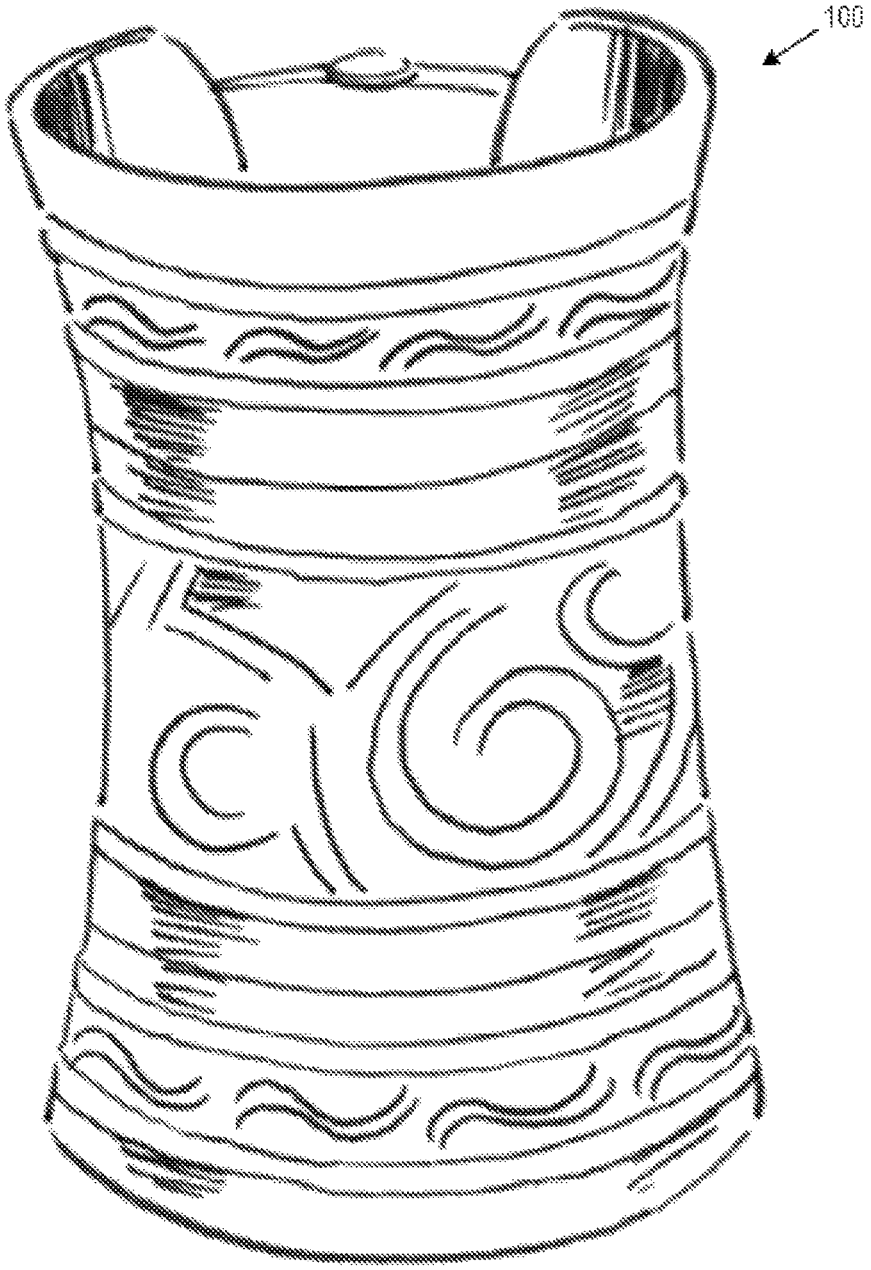
FIGS. 2A and 2B are front and rear views of the bracelet shown in FIG. 1.

Referring now to FIG. 1, there is shown a person wearing a bracelet 100 according to embodiments of the present technology. In this embodiment, the bracelet 100 may be formed of a hard material such as for example metal, stone and/or ceramic. FIG. 2A shows further detail of a shape and ornamental design of the bracelet 100. However, it is understood that the bracelet 100 may have any of a wide variety of other ornamental designs and shapes.

Figure 2B:
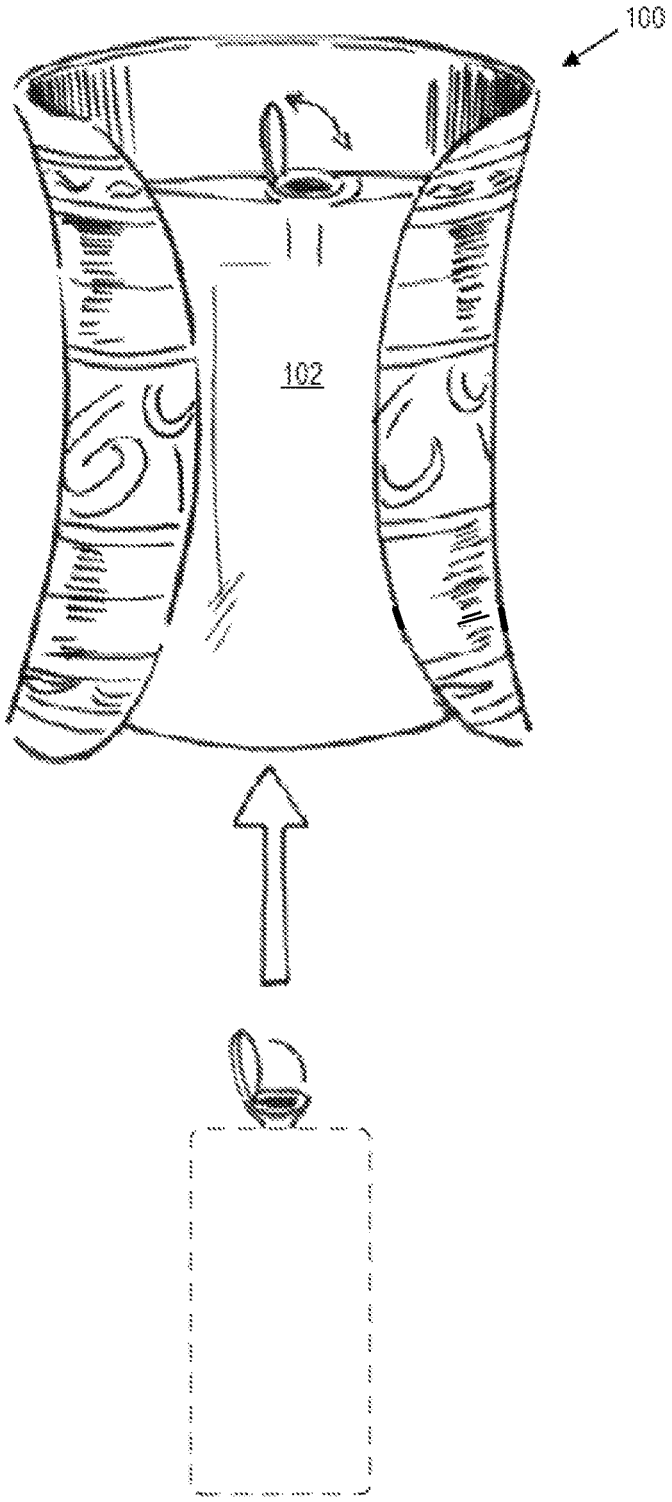
Figure 3:
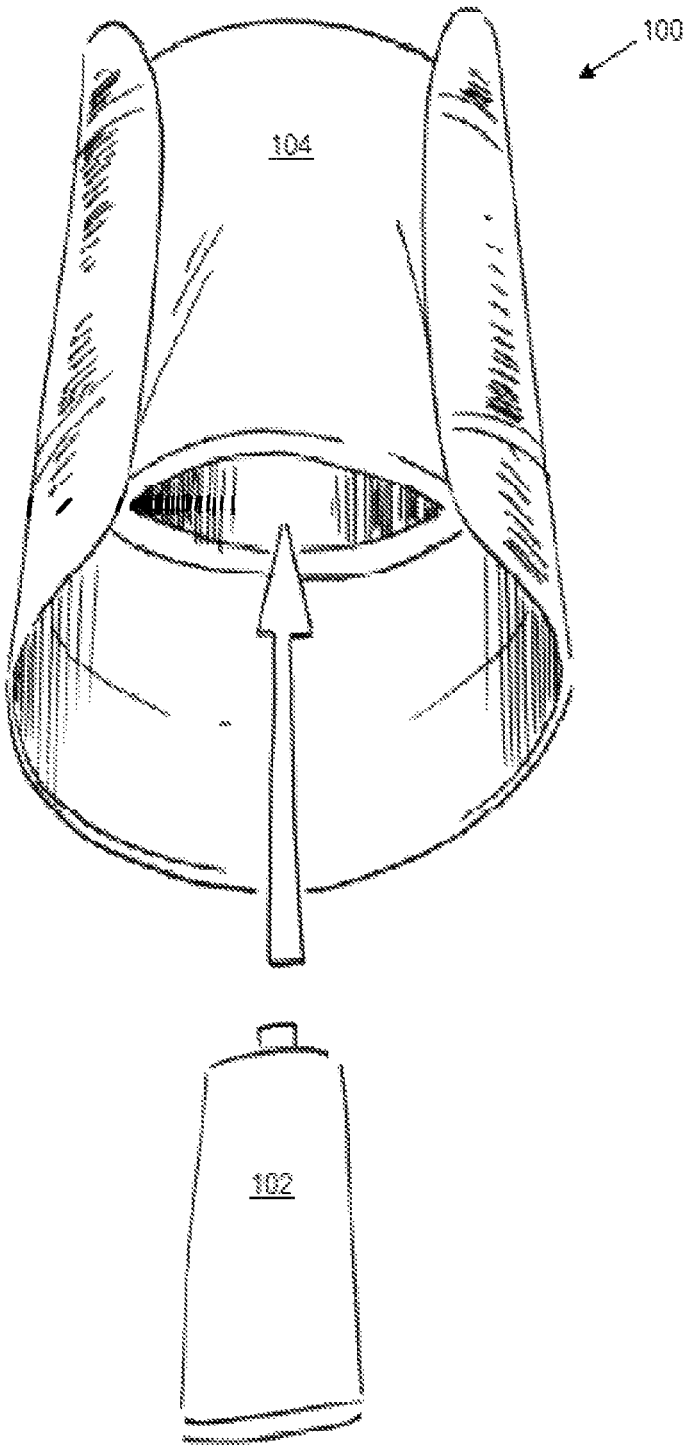
FIG. 3 illustrates a flask insert to be inserted in the bracelet shown in FIG. 1.

Referring now to FIG. 2B, there is shown a rear of the bracelet 100 including a flask 102 configured to store a solution. The flask 102 is removable, and is shown inserted into the bracelet 100, and separated from the bracelet (in dashed lines). In one embodiment, the flask 102 and bracelet 100 may have mating snap components enabling the flask 102 to snap into position within the interior of the bracelet 100. In further embodiments, the flask 102 may for example have pegs which slide into a track in the interior of bracelet 100 to affix the flask 102 within the interior of the bracelet. Other affixation mechanisms are contemplated. FIG. 3 illustrates a further embodiment where the flask 102 may fit within a holder 104 mounted within the bracelet 100.

In the embodiment shown, the opening of the bracelet 100 may be worn facing the anterior of a wearer's wrist (the portion of the wrist adjacent the palm). In such embodiments, the flask is configured to rest on top of the posterior of the wearer's wrist. In further embodiments, the opening of the bracelet 100 may be worn facing the posterior of the wearer's wrist, in which case the flask would rest on top of the anterior of the wearer's wrist.

Figure 4:
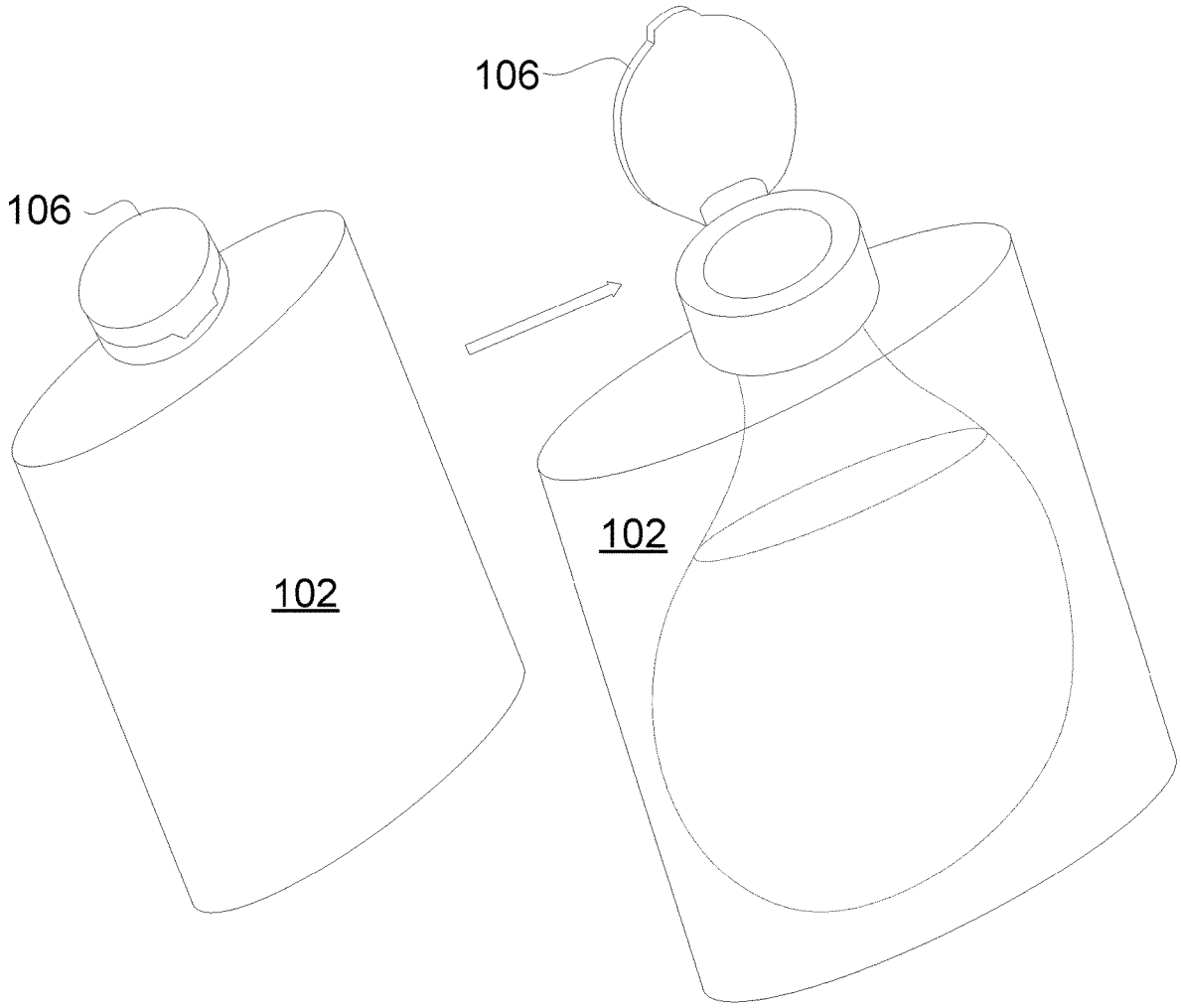
FIG. 4 illustrates a flask insert for use in the bracelet shown in FIG. 1.

FIG. 4 shows a cap 106 of the flask 102 in a closed and in an open position. The cap 104 may for example be held in the closed position using a snap fit, though screw tops and other types of caps may be used. The flask 102 may in general have a wide flat profile to enable the bracelet and flask to be comfortably worn on a wearer's wrist. It is possible that the flask have a first concave surface and a second convex surface, to follow the curvature of the wrist. The flask 102 may be formed of a soft, durable plastic material, though the flask be formed of other materials in further embodiments.

Figure 5:
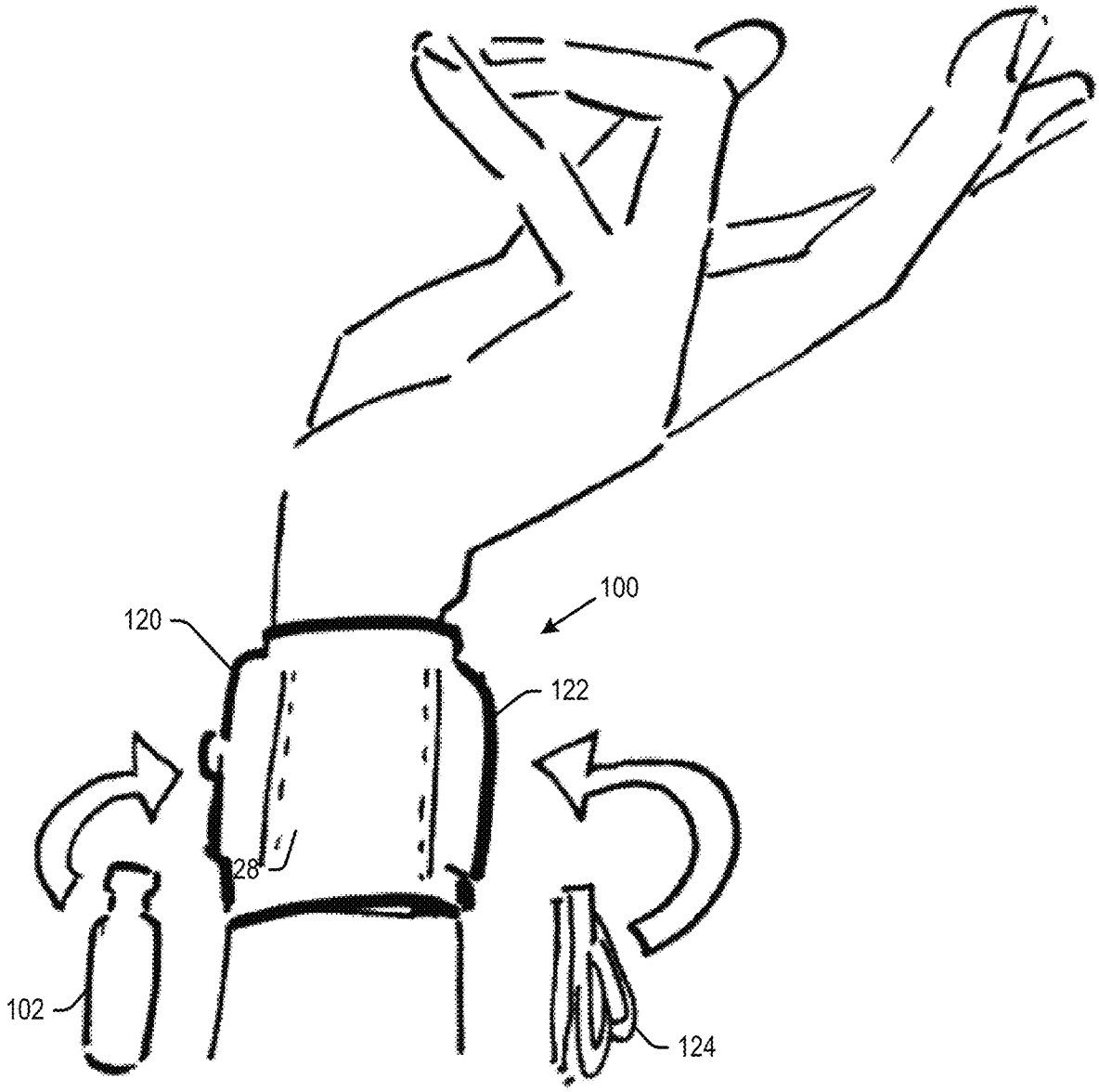
FIG. 5 illustrates a side view of a bracelet worn by a person according to a further embodiment of the present technology.

FIG. 5 illustrates a bracelet 100 according to a further embodiment of the present technology. The bracelet 100 shown in FIG. 5 includes a first compartment 120 for storing a flask 102 as described above, and a second compartment 122 for storing a small object 124 such as a mask. The bracelet 100 may be made of soft or hard materials including for example metals, stone, ceramic, leather, fabric and/or plastic. In one embodiment, the compartments 120 and 122 are on opposed sides of the bracelet 100. Thus, for example, the bracelet 100 may be worn with the first compartment 120 facing the anterior of the wrist, and the compartment 122 facing the posterior of the wrist. The compartments 120 and 122 may be positioned at other locations on the bracelet 100, and need not be opposed to each other, in further embodiments.

Figure 6A:
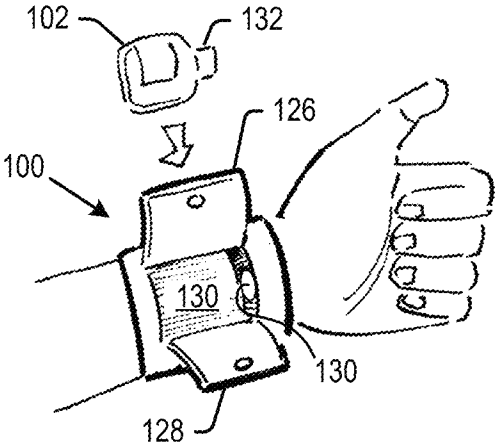
FIGS. 6A and 6B are rear views of the bracelet shown in FIG. 5.
Figure 6B:
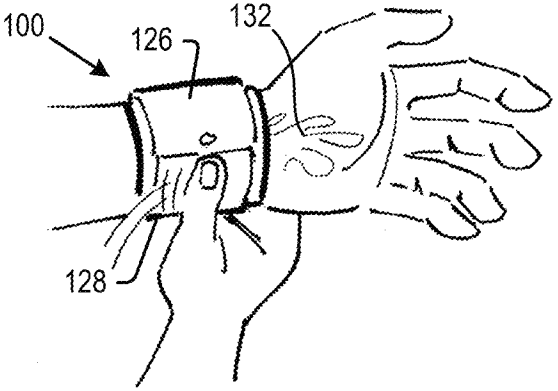

FIGS. 6A and 6B show further detail of the compartment 120 on the anterior of a wearer's wrist. The compartment 120 in this embodiment may be covered by a pair of flaps 126 and 128 which may be opened as shown in FIG. 6A to allow access to the interior of compartment 120, and which may be closed as shown in FIG. 6B. The flaps 126 and 128 may be sealed together to close compartment 120, for example using a clasp, snap, Velcro® fastener, zipper, magnet or other closure mechanism. In further embodiments, there may be a single flap covering the entire compartment 120. The one or more flaps may be made of a pliant material, such as for example leather, fabric or plastic.

In embodiments, the flask 102 may be stored within the compartment 120 and may be easily accessed and removed by opening one or more of the flaps 126, 128. In further embodiments, compartment 120 may include an opening 130 (FIG. 6A) which extends through the bracelet 100 to an edge of the bracelet adjacent a palm of the wearer. In such embodiments, the compartment 120 may be configured to receive a flask 102 including a neck 132 fitting within the opening 130 and extending to an edge of the bracelet 100. The neck 132 may be press fit or snap fit into the opening 130, though other known methods of securing neck 132 within opening 130 may be used.

When such a flask 102 is positioned within compartment 120, with neck 132 seated within opening 130, a user may press on a flap 126, 128 (when closed over compartment 120) to apply pressure to the flask 102. As a result, the flask deforms and a discrete amount of fluid 132 within the flask 102 is forced out of the flask onto a palm of the wearer as shown in FIG. 6B. In this way, users can store fluid such as an antibacterial gel in a flask within compartment 120 and have ready access to the gel simply by pressing on the bracelet 100. In this embodiment, the flask 102 may include a one-way valve in the neck 132 of the flask to prevent leakage of the fluid within the flask when not in use.

Figure 7A:
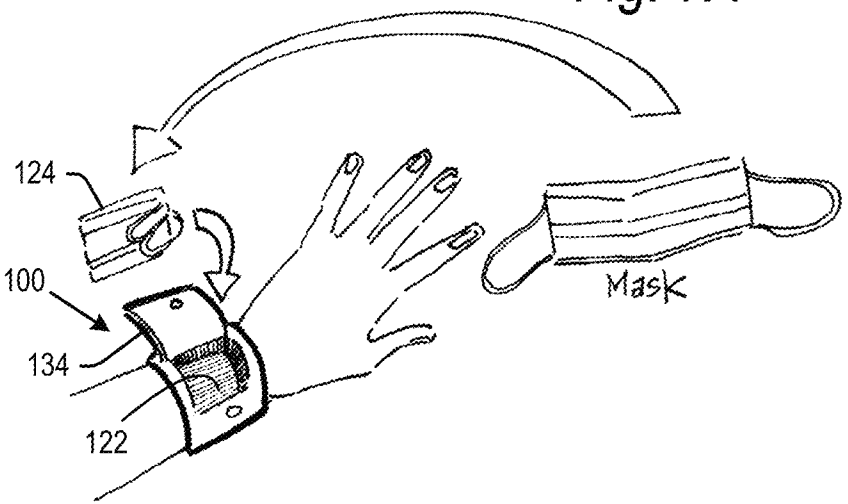
FIGS. 7A and 7B are front views of the bracelet shown in FIG. 5.
Figure 7B:
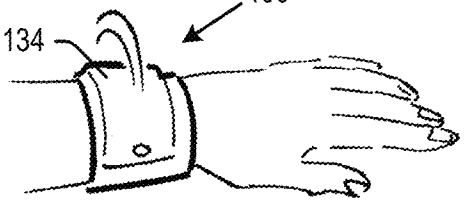

FIGS. 7A and 7B show further detail of the compartment 122 on the posterior of a wearer's wrist. The compartment 122 in this embodiment may be covered by a flap 134 which may be opened as shown in FIG. 7A to allow access to the interior of compartment 122, and which may be closed as shown in FIG. 7B. The flap 134 may be sealed when closed using for example a clasp, snap, Velcro® fastener, zipper, magnet or other closure mechanism. In further embodiments, there may be a pair of flaps covering the compartment 122. The one or more flaps may be made of a hard or pliant material, such as for example metal, leather, fabric or plastic.

In embodiments, the compartment 122 may be used to store, and provide easy access to, a small object 124, which in embodiments may be a mask. As noted in the Background section, people frequently forget their masks when in a public place where masks are presently desirable or mandatory given the COVID-19 pandemic. The present technology solves this problem by providing convenient mask storage, so that a mask is always available. In embodiments, compartment 122 may be capable of storing multiple masks.

Figure 8B:
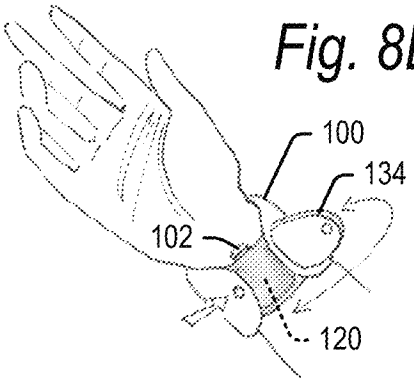
FIGS. 8A and 8B illustrate front and rear views of a bracelet according to a further embodiment of the present technology.
Figure 8A:
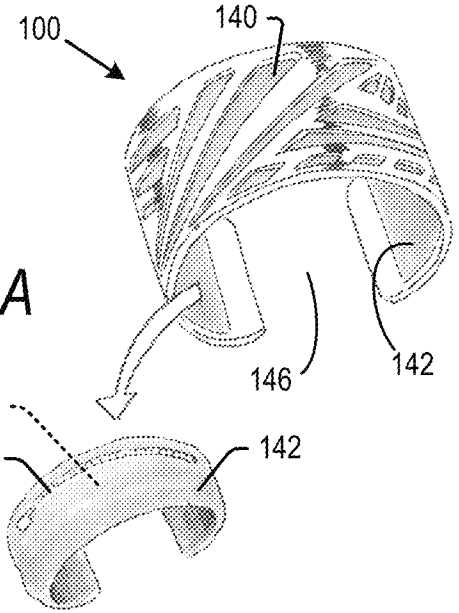

FIGS. 8A-8B show a further embodiment of a bracelet 100 according to embodiments of the present technology. In this embodiment, the bracelet 100 may be made of a hard material, such as metal, stone or ceramic and patterned with various ornamental openings or slits 140 through the bracelet 100. The bracelet 100 in this embodiment may further include an interior lining 142 which affixes to an interior of the bracelet 100. The lining may have a design or color which shows through the openings 140 to enhance the aesthetic or fashion appearance of bracelet 100.

The lining 142 may be removable and may affix within the interior of the bracelet 100 using for example a snap, Velcro® fastener, zipper or other affixation mechanisms. The lining 142 may serve at least two purposes. First, the lining 142 may cushion the bracelet 100 to make the bracelet more comfortable to wear. The lining 142 may be made of a comfortable material such as silk or velvet, though other materials are possible. Second, lining 142 may have a compartment 122 (shown in dashed lines as the interior of compartment 122 is not visible in FIG. 8A). The compartment 122 may be configured to store a small object 124 such as a mask as described above. The compartment 122 may be sealable with the zipper 144 or any of the other closure mechanisms described above.

In the embodiment illustrated in FIG. 8A, the zipper 144 is shown on a surface of the lining 142 facing the bracelet 100. In further embodiments, the zipper 144 or other closure mechanism may face a user's wrist when the bracelet 100 is worn. In such embodiments, the lining 142 may be removable as described above, or the lining 142 may be non-removable.

In the embodiment shown in FIG. 8A, the lining 142 includes a compartment 122 for storing an object 124. In a further embodiment shown in FIG. 8B, the lining 142 may include a compartment 120 for storing a flask 102 holding a fluid such as antibacterial gel. In this embodiment, the compartment 120 may be positioned at a gap section 146 positioned at the anterior of the wrist when the bracelet 100 is worn.

The compartment 120 may be covered with a flap 134 which may open or close, and may be temporarily sealed in the closed position using any of the above-described closure mechanisms. The compartment 120 may receive the flask 102 so that a neck of the flask faces a wearer's palm. As described above, pressing on the lining 142 or closed flap 134 deposits a discrete amount of fluid from within the flask 102 into the wearer's palm. In further embodiments, the lining 142 may include both a compartment 120 for housing a small object 124, and a compartment 122 for housing a flask 102.

Figure 9A:
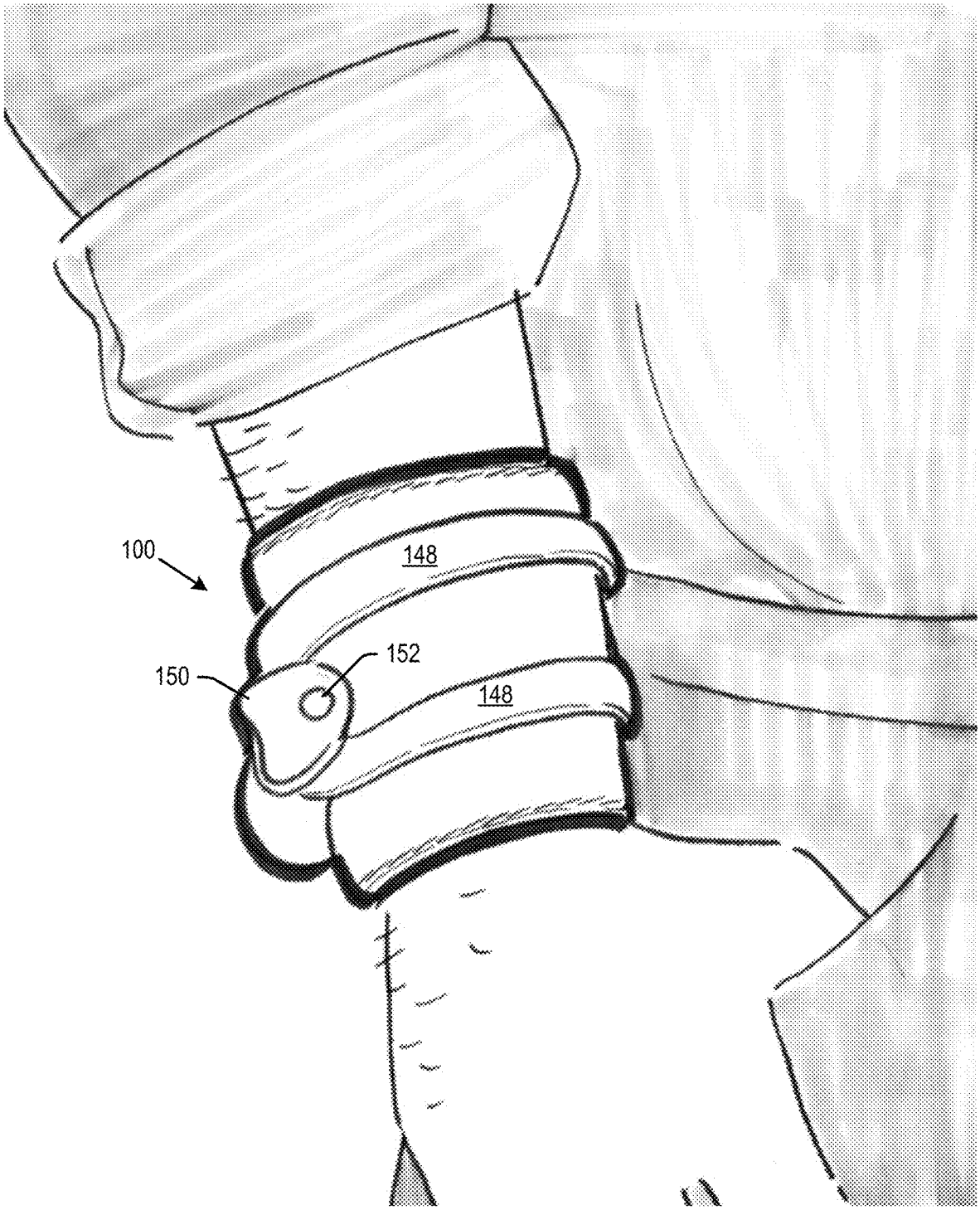
FIG. 9A illustrates a view of a bracelet worn by a person according to a further embodiment of the present technology.
Figure 9C:
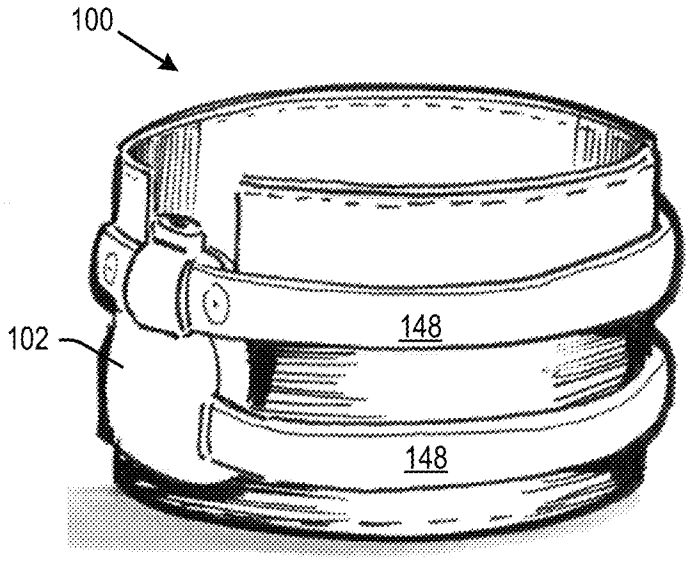
FIGS. 9B and 9C are front and rear views of the bracelet shown in FIG. 9A.
Figure 9B:
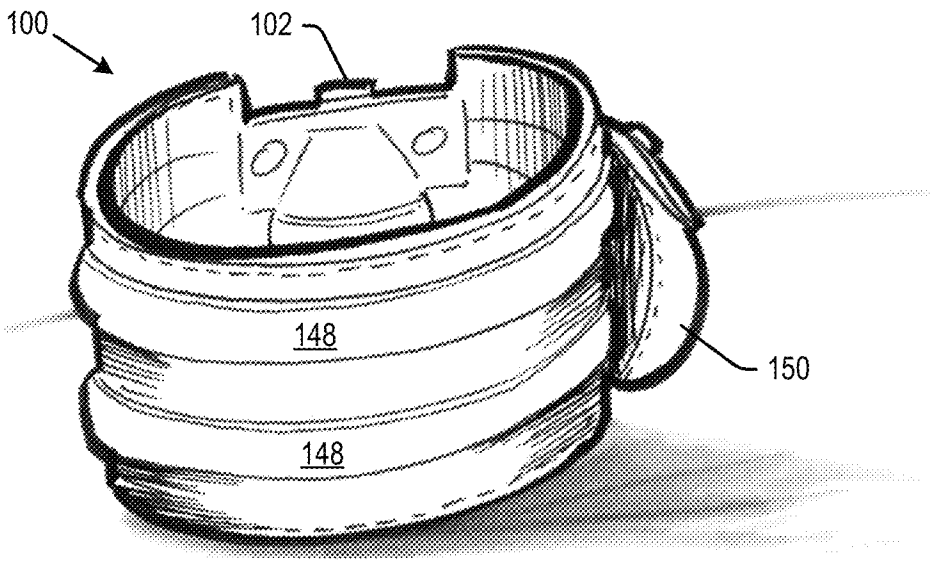

FIGS. 9A-9C show a further embodiment of a bracelet 100 according to embodiments of the present technology. In this embodiment, the bracelet 100 may be made of a hard or soft material, such those mentioned above. The bracelet 100 in this embodiment may further include one or more straps 148 which extend around the bracelet 100. In the illustrated embodiment, there are two straps, but there may be a single strap or more than two straps in further embodiments. As shown in FIG. 9A, the straps 148 may be affixed to the bracelet 100 using a buckle 150 having a first end affixed to a first end of the one or more straps and a second end including a closure mechanism 152 for affixing a second end of the one or more straps to the bracelet 100. Closure mechanism 152 may be any of the closure mechanisms described above.

The straps 148 serve at least two purposes. First, the straps 148 add an aesthetic or fashion element to the bracelet 100. Second, a flask 102 may be attached to the straps 148 as shown in FIGS. 9B and 9C. In particular, the straps 148 may be threaded through (or otherwise affixed to) a carrier 154 which is configured to removably receive the flask 102. Once positioned in the carrier 154, the wearer may squeeze the flask to dispense a discrete amount of liquid into the palm of the wearer as described above.

Figure 10A:
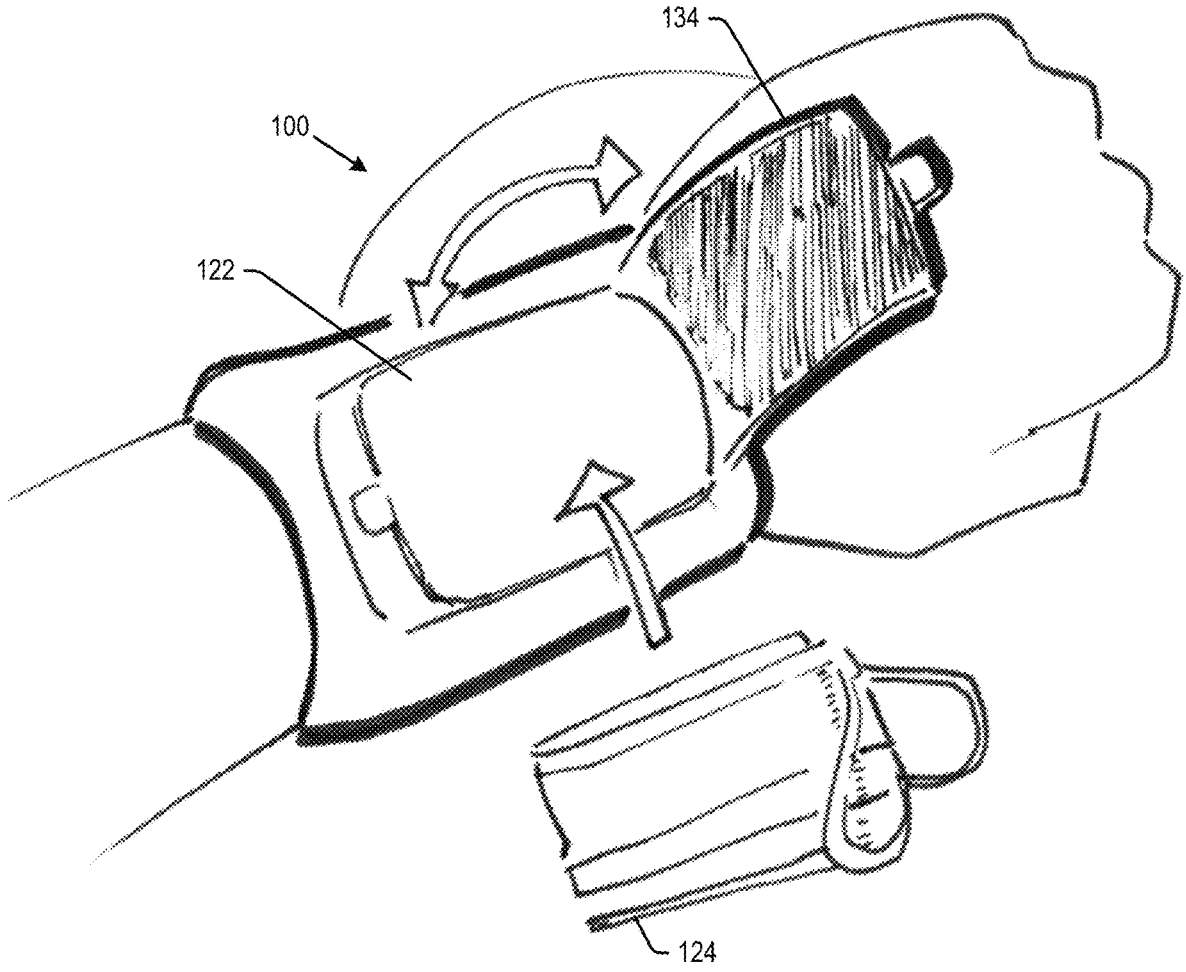
FIG. 10A illustrates a front view of a bracelet worn by a person according to a further embodiment of the present technology.
Figure 10B:
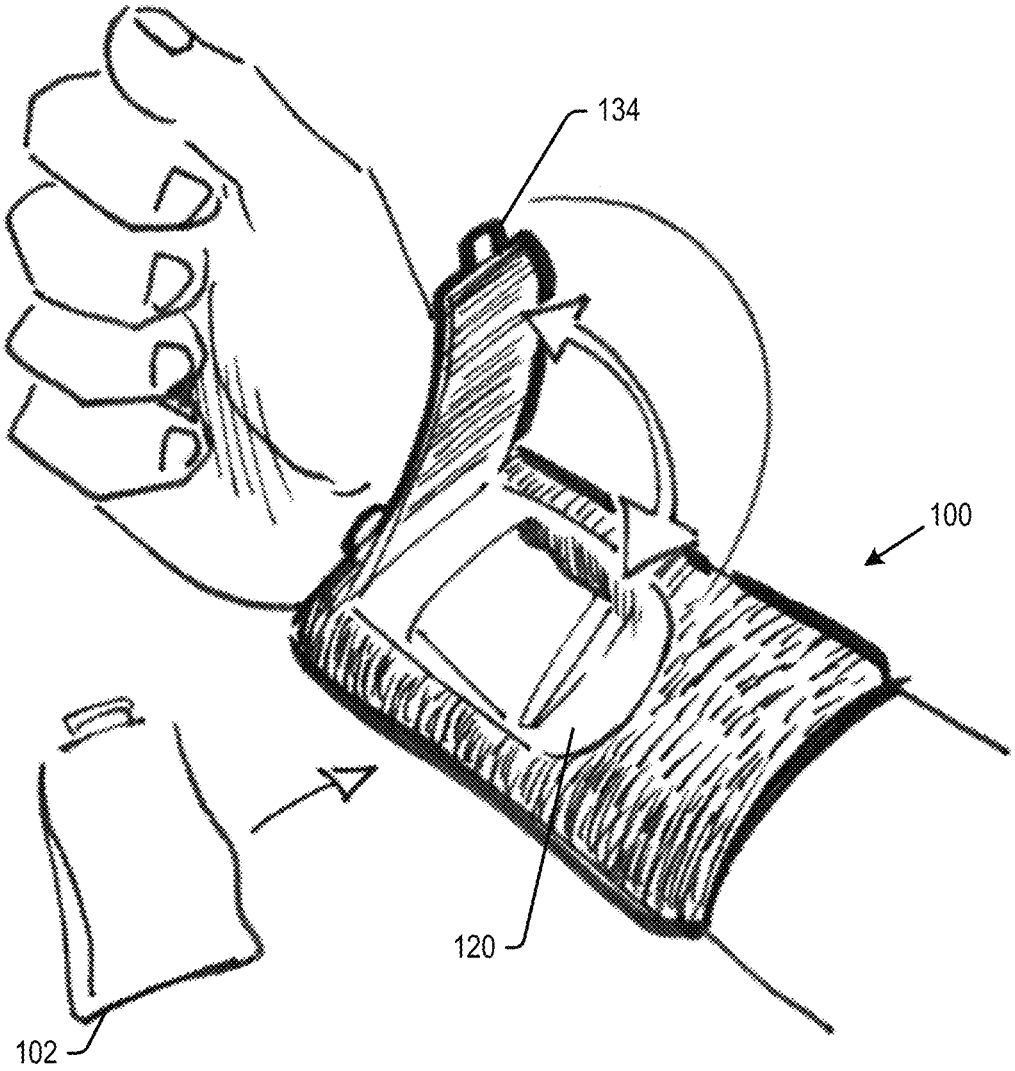
FIG. 10B is a rear view of the bracelet shown in FIG. 10A.

FIGS. 10A-10B show a further embodiment of a bracelet 100 according to embodiments of the present technology. In this embodiment, the bracelet 100 may be made of a hard or soft material, such those mentioned above. In one example, the bracelet 100 may be wristband worn for example during a sports activity. The bracelet may include a compartment 122 for housing a small object 124 such as a mask (FIG. 10A), for example worn on the posterior of the wrist. The bracelet may further or alternatively include a compartment 120 for housing a flask 102 (FIG. 10B), for example worn on the anterior of the wrist. Once positioned in the compartment 120, the wearer may squeeze the flask 102 to dispense a discrete amount of liquid into the palm of the wearer as described above. The compartments 120 and 122 may each be covered by a flap 134 which can be opened or closed. The flap 134 may be sealed in the closed position by a Velcro® fastener, or any of the other closure mechanisms described above.

Figure 11A:
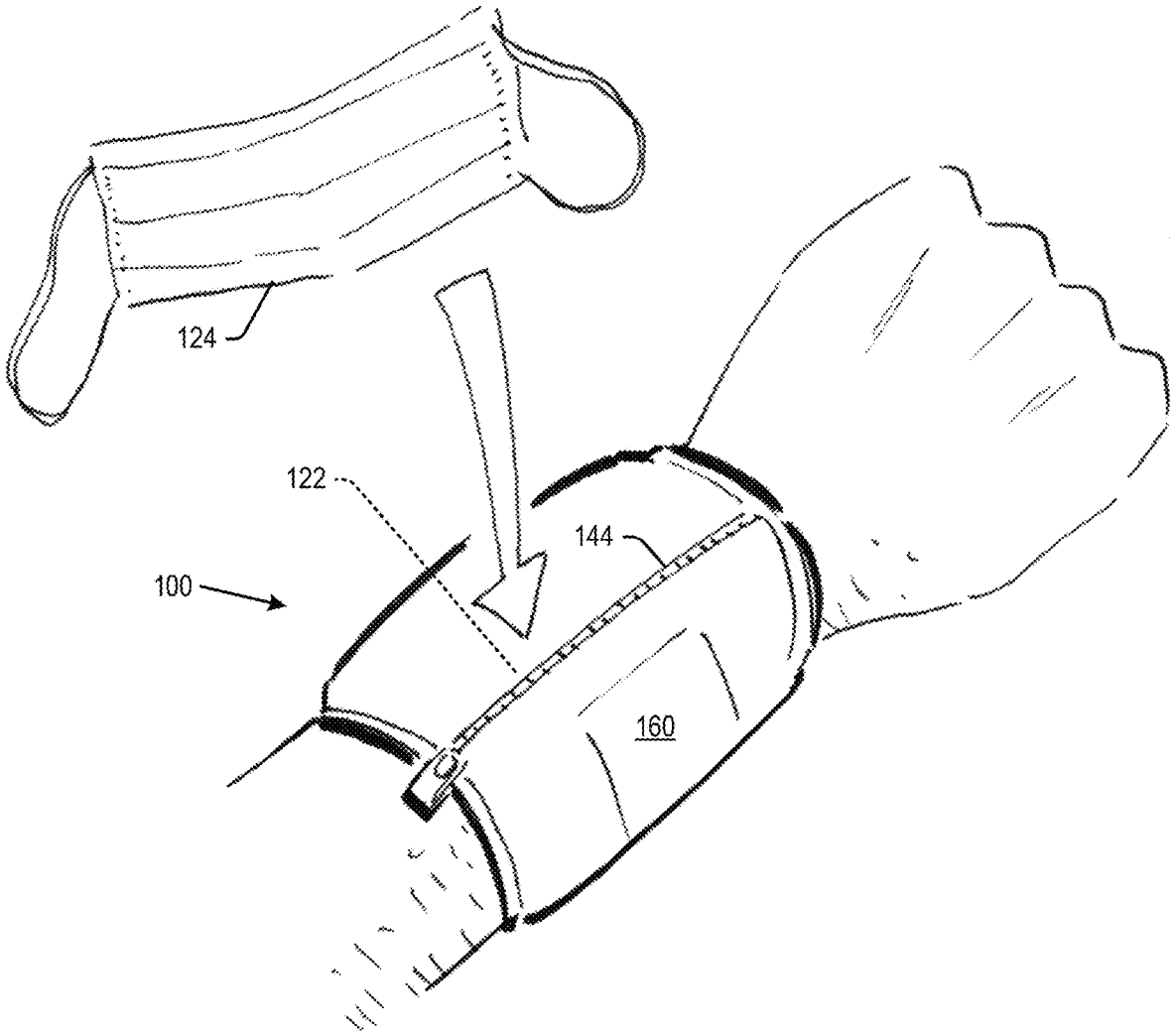
FIG. 11A illustrates a front view of a bracelet worn by a person according to a further embodiment of the present technology.

FIGS. 11A-11C show a further embodiment of a bracelet 100 according to embodiments of the present technology. In this embodiment, the bracelet 100 may be made of a hard or soft material, such those mentioned above. The bracelet 100 of FIGS. 11A-11C may be a sports bracelet such as a wristband as in FIGS. 10A-10B described above, but the compartment 122 (FIG. 11A) and compartment 120 (FIG. 11B) in this embodiment are shown sealed by a zipper 144. FIG. 11C shows the sports bracelet 100 with an emblem 160, which may include a graphic, such as a logo, written word(s) or company name and/or an image.

Figure 12A:
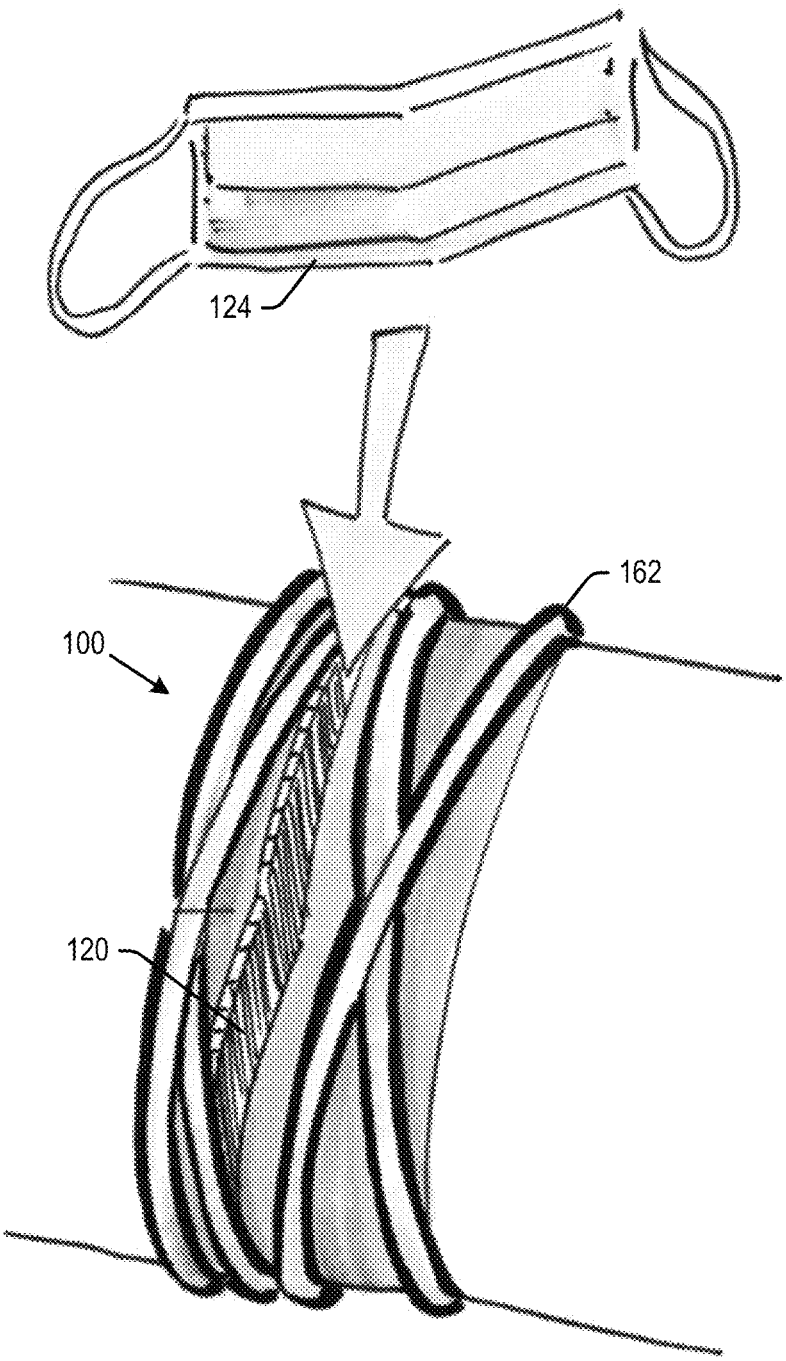
FIG. 12A illustrates a front view of a bracelet worn by a person according to a further embodiment of the present technology.
Figure 12B:
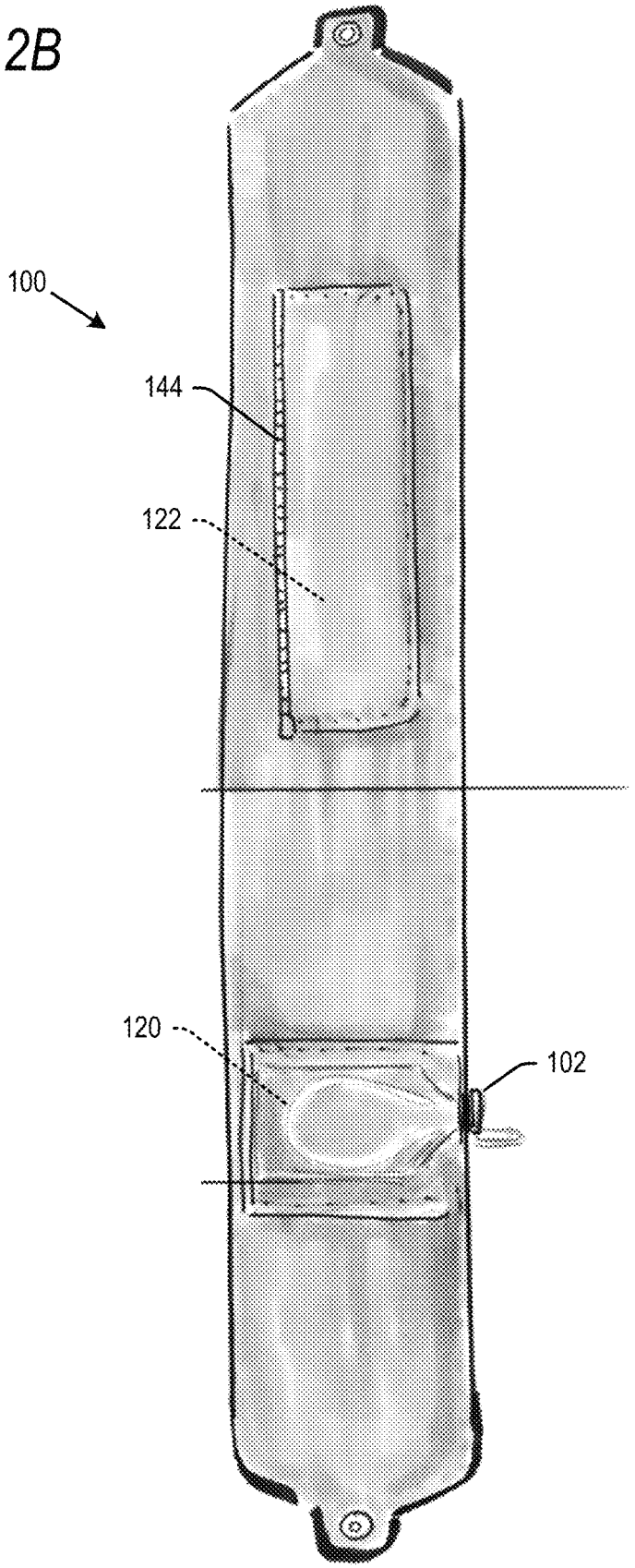
FIG. 12B is a rear view of the bracelet shown in FIG. 12A.

FIGS. 12A-12B show a further embodiment of a bracelet 100 according to embodiments of the present technology. In this embodiment, the bracelet 100 may be made of a hard or soft material, such those mentioned above. The bracelet 100 may further include ornamental bands 162 in any of a variety or patterns. The bracelet 100 may include a compartment 122 between the bands for storing a small object 124 such as a mask. When worn, the compartment 122 may open to an exterior of the bracelet facing away from the wrist, as shown in FIG. 12A. The bracelet 100 may alternatively or additionally include a compartment 120 between the bands for storing a flask 102 as described above. In a further embodiment, when worn, the compartment 120 and/or compartment 122 may open to an interior of the bracelet facing toward the wrist, as shown in FIG. 12B.

In summary, in one example, the present technology relates to a bracelet, comprising: a first compartment configured to store a flask for dispensing a liquid; and a second compartment configured to store an object.

In another example, the present technology relates to a bracelet, comprising: a first compartment configured to be positioned at an anterior of a wrist of a wearer when the bracelet is worn, and the first compartment configured to store a flask for dispensing a liquid; a first opening to the first compartment; a second compartment configured to be positioned at a posterior of the wrist of the wearer when the bracelet is worn, and the second compartment configured to store an object; and a second opening to the second compartment.

In another example, the present technology relates to a bracelet, comprising: a first compartment configured to be positioned at an anterior of a wrist of a wearer when the bracelet is worn, and the first compartment configured to store a flask for dispensing a liquid, the first compartment including an opening for receiving a neck of the flask, the first compartment configured to dispense a discrete amount of fluid from the flask to a palm of the wearer upon pressing on the flask; and a second compartment configured to be positioned at a posterior of the wrist of the wearer when the bracelet is worn, and the second compartment configured to store a mask.

The foregoing detailed description has been presented for purposes of illustration and description. It is not intended to be exhaustive or to limit the subject matter claimed herein to the precise form(s) disclosed. Many modifications and variations are possible in light of the above teachings. The described embodiments were chosen in order to best explain the principles of the disclosed technology and its practical application to thereby enable others skilled in the art to best utilize the technology in various embodiments and with various modifications as are suited to the particular use contemplated. It is intended that the scope be defined by the claims appended hereto.

What is claimed is:

1. A bracelet, comprising:

a first compartment configured to store a flask for dispensing a liquid;

a second compartment configured to store an object; and a lining, wherein at least one of the first and second compartments are positioned in the lining.

2. The bracelet of claim 1, wherein the first compartment includes an opening configured to receive a neck of the flask, the first compartment configured to dispense a discrete amount of fluid from the flask to a palm of the wearer upon pressing on the flask.

3. The bracelet of claim 1, wherein the object is a mask.

4. The bracelet of claim 1, wherein the first compartment is covered by at least one flap movable between a first position where the at least one flap covers the first compartment and a second position where the at least one flap is open to allow access to the first compartment.

5. The bracelet of claim 4, further comprising a closure mechanism for sealing the at least one flap against the bracelet when the at least one flap is in the first position.

6. The bracelet of claim 1, wherein the second compartment is covered by at least one flap movable between a first position where the at least one flap covers the second compartment and a second position where the at least one flap is open to allow access to the second compartment.

7. The bracelet of claim 6, further comprising a closure mechanism for sealing the at least one flap against the bracelet when the at least one flap is in the first position.

8. The bracelet of claim 1, further comprising a zipper for sealing at least one of the first and second compartments.

9. The bracelet of claim 1, wherein the bracelet is formed of at least one of metal, stone, ceramic, leather and fabric.

10. The bracelet of claim 1, wherein the bracelet comprises ornamental aspects on an exterior of bracelet, wherein an opening of at least one of the first and second compartments is positioned between the ornamental aspects.

11. The bracelet of claim 1, wherein the lining is removable.

12. A bracelet, comprising:

a first compartment configured to be positioned at an anterior of a wrist of a wearer when the bracelet is worn, and the first compartment configured to store a flask for dispensing a liquid;

a first opening to the first compartment;

a second compartment configured to be positioned at a posterior of the wrist of the wearer when the bracelet is worn, and the second compartment configured to store an object;

a second opening to the second compartment; and a lining, wherein at least one of the first and second compartments are positioned in the lining.

13. The bracelet of claim 12, wherein at least one of the first and second openings is on an interior of the bracelet, facing the wrist of the wearer when worn.

14. The bracelet of claim 12, wherein at least one of the first and second openings is on an exterior of the bracelet, facing away from the wrist of the wearer when worn.

15. The bracelet of claim 12, wherein the first compartment includes a third opening configured to receive a neck of the flask, the first compartment configured to dispense a discrete amount of fluid from the flask to a palm of the wearer upon pressing on the flask.

16. The bracelet of claim 12, wherein the object is a mask.

17. The bracelet of claim 12, wherein at least one of the first and second compartments are covered by at least one flap movable between a first position where the at least one flap covers the at least one of the first and second compartments, and a second position where the at least one flap is open to allow access to the at least one of the first and second compartments.

18. The bracelet of claim 17, further comprising a closure mechanism for sealing the at least one flap against the bracelet when the at least one flap is in the first position.

19. A bracelet, comprising:

a first compartment configured to be positioned at an anterior of a wrist of a wearer when the bracelet is worn, and the first compartment configured to store a flask for dispensing a liquid, the first compartment including an opening for receiving a neck of the flask, the first compartment configured to dispense a discrete amount of fluid from the flask to a palm of the wearer upon pressing on the flask; and a second compartment configured to be positioned at a posterior of the wrist of the wearer when the bracelet is worn, and the second compartment configured to store a mask; and a lining, wherein at least one of the first and second compartments are positioned in the lining.

* * * * *